United States Patent [19]

Klitzky

[11] Patent Number: 4,568,055

[45] Date of Patent: Feb. 4, 1986

[54] FRAME HANGING AND JOINING DEVICE

[76] Inventor: David Klitzky, 954 Burton Ave., Highland Park, Ill. 60035

[21] Appl. No.: 546,374

[22] Filed: Oct. 28, 1983

[51] Int. Cl.[4] ..... A47G 1/24

[52] U.S. Cl. ..... 248/496; 40/152.1; 248/477

[58] Field of Search ..... 248/496, 495, 476, 477, 248/208, 220.1; 40/152.1

[56] References Cited

U.S. PATENT DOCUMENTS

| | | | |
|---|---|---|---|
| 2,581,843 | 1/1952 | Edwards | 40/152.1 |
| 3,256,630 | 6/1966 | Spector | 40/152.1 |
| 3,492,034 | 1/1970 | Skipp | 40/152.1 |
| 4,216,597 | 8/1980 | Kocina et al. | 248/496 |
| 4,262,874 | 4/1981 | Seigh | 248/496 |
| 4,420,138 | 12/1983 | Sobel | 248/496 |

*Primary Examiner*—Ramon S. Britts
*Assistant Examiner*—Ramon O. Ramirez
*Attorney, Agent, or Firm*—Dick and Harris

[57] ABSTRACT

An improved frame hanging and joining device comprising a bracket having a platform with teeth that engage a nail or screw protruding from a wall to support a frame on the wall, hold the frame together and provide for height adjustment of one end of the frame with respect to the other.

11 Claims, 7 Drawing Figures

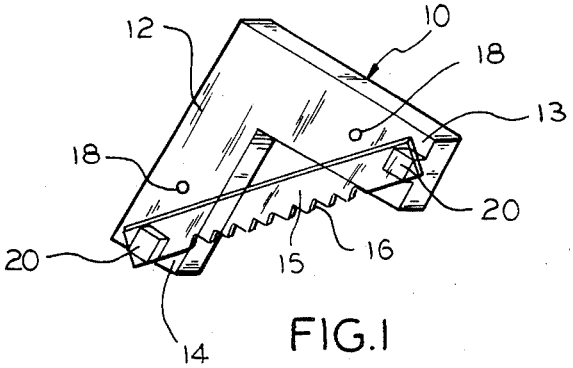
FIG.1
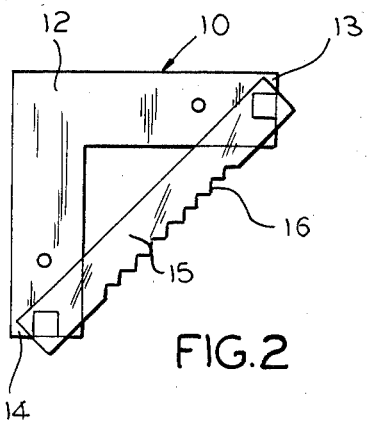
FIG.2
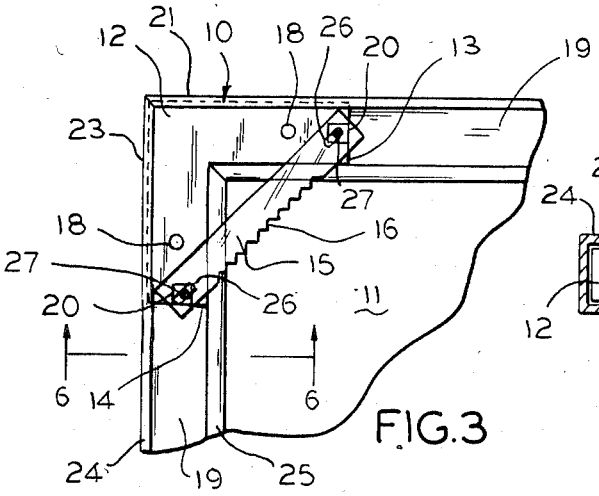
FIG.3
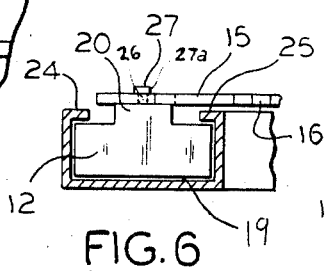
FIG.6
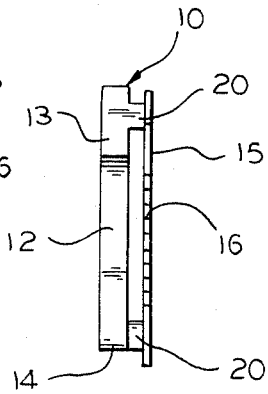
FIG.4
FIG.5
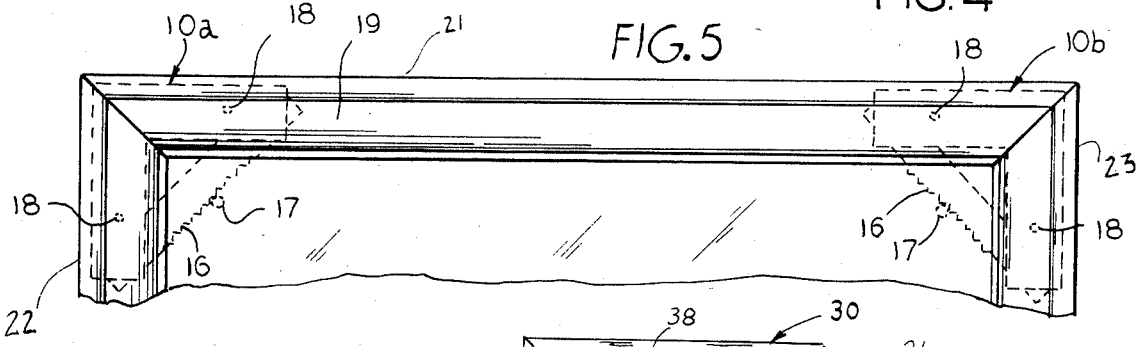
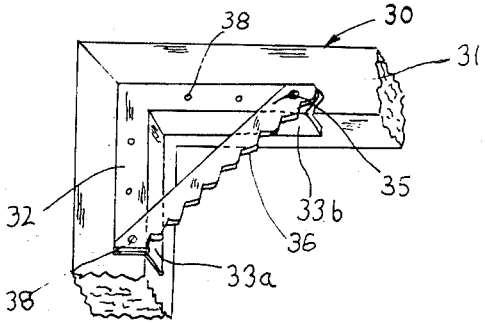
FIG.7

FRAME HANGING AND JOINING DEVICE

BACKGROUND OF THE INVENTION

The present invention relates generally to picture hanging devices and particularly an improved frame hanging and frame component joining device which mounts the frame on a wall and allows for height adjustment of one end of the frame with respect to the other.

Various devices currently exist that attempt to facilitate the process of hanging picture frames or similar types of frames. One type of picture hanging product are "nail-less" hangers which comprise an adhesive fabric with a hook attached thereto. However, not only do such devices considerably affect the appearance of the wall when no longer needed and/or removed, but such a single hook arrangement requires that the hook engage virtually the exact center of the back of the frame to be mounted in order to be straight, which is often quite difficult to achieve.

Furthermore, another type of picture hanging or mounting product are the sets that include wire, screw eyes, hook-shaped hangers and nails. However, such sets require that the screw eyes first be affixed to the back of the frame, the wire threaded and tied therethrough and the hook-shaped hangers affixed to the wall by the nails. Hence, the relative elevation of the screw eyes, length of wire and position of the hook-shaped hangers can all have a substantial effect on the final elevation and inclination of the frame, thereby making it at times a tedious process to hang a picture at precisely the desired elevation and without undesired inclination.

Yet another form of picture hanging or mounting device is double-faced adhesive tape which not only has relatively low weight support limits, but also often visually damages a wall if removed. Also, the picture mounting systems employing a plate having teeth along its bottom edge affixed to the rear of a frame which rest upon a nail inserted in the wall, allow for undesired rotation of the picture frame about the nail which serves as a pivot point.

It should also be noted that devices of various shapes exist for joining together and maintaining in assembled fashion the corners of the picture frames. The foregoing include devices that are telescopically received within rescesses formed in the picture frames.

Clearly, there is a need for an improved method of hanging, or mounting and picture frames on other such items.

Consequently, the present invention has as an object of accomplishing the dual purposes of holding a frame together and mounting it at a desired elevation and orientation.

In addition the present invention has as an object the allowance for adjustment for discrepancies in the height of one end of the frame from the other when mounted.

Another object of the present invention is to provide the additional load carrying capacity and security of a dual wall protruding nail, screw or other pin-like support arrangement.

Yet another object of the present invention is to prevent the undesired rotation of the frame about the pin-like member supporting the frame on the wall.

Yet another object of the present invention is to minimize the effect that the frame mounting device will have on the wall.

These and other objects of the invention will become apparent in light of the present specification and drawings.

SUMMARY OF THE INVENTION

The invention comprises an improved frame hanging and joining device for holding together, mounting and displaying of frames upon a substantially vertical wall through the use of one or more of the devices in cooperation with one or more pins protruding from the wall. Specifically contemplated in the first preferred embodiment are, a bracket member having a configuration substantially conforming to the configuration of a portion of the frame and serving to maintain the frame components in a joined or assembled configuration. The rear of the bracket is affixed within the rear of the frame. The front of the bracket is then attachable to the wall for the display of the frame thereon. The device further allows for compensation and discrepancies in the heights of two or more pin members affixed to the wall so as to allow for the picture frame to be hung in a straight fashion nevertheless. Hence, when two or more of the devices are affixed at opposite ends of the frame in order to mount the frame on the wall by engaging and resting upon the protruding pins, not only is the frame affixed and displayed at a desired level and orientation upon the wall, but compensation is possible for height differences between the protruding pins.

More specifically, a first embodiment of the device includes a platform member spanning, and "L" shaped bracket, member with a spacer positioned therebetween so as to provide sufficient clearance from the back of the frame to permit the platform to engage and rest upon one or more of the protruding pins at one of the plurality of teeth along its lower edge, with the head of the pin extending into the area between the bracket and the platform. In addition, the foregoing space permits telescopic receipt of the bracket member by the channel formed in the rear of the frame components.

In a second embodiment of the invention, the top portion of the bracket member has depending flanges along one side so as to fit over a corner of the frame, where it is affixed thereto, with the aforementioned platform with its plurality of teeth, positioned thereon to engage one or more of the pins protruding from the wall.

Since any of the plurality of teeth are capable of engaging and resting upon any of the protruding pins, the elevation of the frame on the wall can be altered upwards or downwards by simply engaging a different tooth. Hence, the range of such possible vertical alteration is determined by the vertical distance between the upper most tooth and the lower most tooth thereon. However, it is also contemplated that the platform member can be adjustable along its diagonal position across the bracket member to raise and lower the position of its teeth to accommodate in a facilitated manner, extreme adjustments in the position of the frame on the pin members so as to increase the range of possible alteration.

Furthermore, the present invention serves to engage and hold in an assembled fashion various components of the frame, which in the preferred embodiment are vertical and horizontal substantially straight members which fit together orthogonally. The bracket is received telescopically by channels formed within the straight frame component members, in the first embodiment at its corners, in order to maintain the frame in an assembled fashion while simultaneously providing means for the adjustable positioning and mounting of the frame on the wall.

BRIEF DESCRIPTION OF THE DRAWINGS

FIG. 1 is perspective view of the improved frame joining and hanging device showing particularly the "L" shaped bracket member, platform member, spacers, teeth, and fasteners.

FIG. 2 is a front elevational view of the improved frame joining and hanging device likewise showing the "L" shaped bracket member, platform member, teeth, spacers and fasteners.

FIG. 3 if a partial elevational front view of the improved frame joining and hanging device affixed to a picture frame.

FIG. 4 is a right hand side elevational view of the improved picture frame joining and hanging device showing in particular the "L" shaped bracket member, plate member, teeth, and spacers.

FIG. 5 is a partial rear elevational view of a picture frame with two improved frame joining and hanging devices affixed to the back of the picture frame, and shown in phantom, so as to mount the picture frame.

FIG. 6 is a cross-sectional view taken along line 6-6 of FIG. 3 in the direction of the arrows showing bracket being telescopically received within the channel formed within the frame component.

FIG. 7 is a perspective view of the second embodiment of the improved joining and hanging device showing particularly the bracket member, depending flanges, platform member, teeth and fasteners.

DETAILED DESCRIPTION OF THE DRAWINGS

While this invention is susceptible of embodiment in many different forms, it is shown in the drawings and will herein be described in detail, two specific embodiments, with the understanding that the present disclosure is to be considered as an exemplification of the principals of the invention and is not intended to limit the invention to the embodiments illustrated.

The first embodiment frame joining and hanging device, (hereinafter referred to as "frame mounting device 10") is shown in FIGS. 1 and 2 as comprising "L" shaped bracket member 12, with platform member 15 mounted thereon. Specifically, platform member 15 spans from bracket member end 14, where it is mounted upon spacer element 20, to bracket member end 13, where it is likewise mounted upon a spacer element 20. Though the embodiment described herein employes a solid "L" shaped configuration for bracket member 12, varying shape thereof substantially corresponding to the shape of the place of frame 11 where mounting device 10 will be affixed to hold frame 11 together as well as mount frame 11 to the wall are contemplated as being within the scope of the invention. For example, among other shapes, bracket member 12 could be rounded or "V" shaped in order to fit the shape of frame 11 to which it will be attached.

Also shown in FIGS. 1 and 2 are fasteners 18 within bracket member 12 which are one of the alternatives for affixation of the device 10 to the picture frame intended to be mounted which is shown in FIGS. 3 and 5. Platform 15 is provided with a series of teeth 16 along at least one of its edges in order to engage protruding pin members 17, e.g. one or more nails or screws, protruding from a wall, as shown in FIG. 5 as will be explained in greater detail hereinafter.

In turn, FIG. 3 illustrates a partial rear elevational view of frame 11, intended to be hung on a wall (not shown in FIG. 3) and including frame mounting device 10 affixed to a corner of frame 11. Channel 19 formed within frame 11, telescopically receives "L" shaped bracket 12 of mounting device 10 therein at a corner of frame 11. Fasteners 18, either screws or the like, pass through "L" shaped bracket 12 in the preferred embodiment for affixation of frame mounting device 10 to frame 11. Platform 15 has series of teeth 16 along one edge and affixed at its ends to spacers 20 at ends 14 and 13 respectively of "L" shaped bracket member 12. As will be explained in greater detail hereinafter, any of the series of teeth 16 is capable of engaging and resting upon protruding pin member 17, a nail, screw or the like, protruding from a wall (not shown in FIG. 3) so as to mount frame 11 upon a wall when another frame mounting device is similarly employed at the other top corner of frame 11.

Frame mounting device 10 is shown in side elevational view in FIG. 4 with platform 15 having series of teeth 16 thereon, affixed to spacers 20 in turn being affixed at ends 13 and 14 of "L" bracket 12. Spacers 20 serve to separate platform 15 from bracket 12 and frame 11 so as to permit the head of pin 17 to fit therebetween as well as to provide clearance away from frame 11 for the sliding telescopic receipt of bracket 12 within channel 19 of frame 11.

In operation, as seen in FIG. 5 of the preferred embodiment, one frame mounting device **10*a* is affixed to the back of frame 11, which is intended to be mounted to a wall (not shown in FIG. 5) and another frame mounting device 10*b* is affixed to the back of frame 11. Both frame mounting devices 10*a* and 10*b* are positioned at opposite top corners of frame 11 within channel 19 formed within frame 11 and can be further affixed therein by tightening of fasteners 18. As seen in FIGS. 3 and 6, bracket 12 is thereby slidingly and telescopically received within channel 19 and partially surrounded by flanges 24 and 25**.

Furthermore as shown in FIG. 5, frame mounting devices **10*a* and 10*b* serve to hold together frame 11 by joining frame vertical component 22 to frame horizontal component 21 and frame vertical component 23 to frame horizontal component 21, respectively in a horizontal fashion. In this manner frame mounting devices 10*a* and 10*b* serve to hold together frame 11 at its corners as well as simultaneously mount frame 11** on the wall.

One or more protruding pin members 17 are affixed to the wall at or about the desired elevation for frame 11 and separated a sufficient distance so that one or more of the teeth 16 of platform 15 of frame mounting devices **10*a* and 10*b*, at a time, can rest thereon thereby mounting frame 11 on the wall (not shown in FIG. 5). The head of one or more pin members 17 fits into the recess between platform 15 and bracket 12 on frame 11. Any discrepancy in the elevation of protruding pin members 17, in the absence of the elevation correction feature of the invention, would result in frame 11** being mounted askew or on a slant, which is not ordinarily desired.

The present invention therefore provides for correction of or compensation for such elevational discrepancy by permitting lifting of the frame 11, and in turn frame mounting devices **10*a* and 10*b* off of their respective protruding pin members 17, and repositioning of different teeth 16 of mounting devices 10***a* and 10*b*, on protruding pin members 17 until frame 11 is no longer askew or on a slant. The range of such possible elevational discrepancy correction depends upon the length of the series of teeth 16 on platform 15. The longer the segment of platform 15 having teeth 16 thereon, the longer the possible range of raising of one end of frame 11 with respect to the other. In turn, the longer the legs are of "L" shaped bracket 12, the length of platform and the maximum possible length of the series of teeth 16 likewise increases.

In addition, as shown in FIG. 3, platform member 15 may be slidably adjustable along its diagonal position upon "L" bracket member 12 through the use of slots 26 and pins 27 formed therein so as to increase the range of possible elevation connection by effectively shifting platform member 15 and its teeth 16 upwardly or downwardly prior to engagement of pin member 17. It is contemplated that pins 27 affixed to bracket member 12 can be freely slidable along slots 26 and hence only restrained when the pins 27 reach the ends of slots 26 or can be selectably held at points intermediate the ends of slots 26 by friction or otherwise.

FIG. 6 illustrates the telescopic receipt of bracket 12 within channel 19, with flange 24 and 25 partially surrounding it, as well as spacer 20 providing clearance of platform 16 to slide unencumbered thereabove which is common to both the stationary platform embodiments shown and described in connection with FIGS. 1, 2 and 4 as well as the sliding platform embodiment shown and described in connection with FIGS. 3 and 6. In addition, FIG. 6 also shows pin 27, provided with pin cap 27*a* which is of a wider diameter than slot 26 through which pin 27 passes, so as to retain platform 16 upon spacers 20.

FIG. 7 illustrates the second embodiment of frame joining and hanging device, (hereinafter referred to as "frame mounting device 30") as comprising bracket member 32, having depending flanges 33*a* and 33*b* and platform member 35 mounted thereon. Also shown in FIG. 7 are fasteners 38, i.e. threaded screws or nails, for affixation of frame mounting device 30 to the picture frame 31. Platform 35 is provided with a series of teeth 36 along at least one of its cedges in order to engage pin members protruding from the wall (not shown) as described in connection with the first embodiment. As shown in FIG. 7 member 30 fits over frame components 31 and is affixed thereto to allow both joining of the frame components and mounting of the frame 31 upon the wall.

A single frame mounting device 10 may also be employed at a corner of frame 11 to engage a single protruding pin member 17 on the wall (not shown) if a diamond-like effect of frame 11 when mounted is desired. The foregoing likewise applies for frame mounting device 30.

While the foregoing has presented two specific embodiments of the present invention, it is to be understood that such embodiments are presented by way of example only, and are not intended to limit the invention. It is expected that others will perceive variations which, while differing from the foregoing, do not depart from the spirit and scope of the invention as herein described and claimed.

What is claimed is:

1. An improved frame hanging and joining system for integrating frame components into a formed frame apparatus and for mounting and displaying said resulting frame apparatus on a substantially vertical wall through the use of one or more of hanging-joining devices in operable cooperation with one or more wall pin members protruding from said wall comprising:

bracket means having a front face and a rear face and a first and second side;

said bracket means further having a first end portion and a second end portion;

frame component means having a rearward attachment surface for accepting, in a restrained adjoining fashion, attachment of said bracket means therealong, said rear face of said bracket means being operably attachable to said adjoining rearward attachment surface of said frame component means, at said first and second sides of said bracket means, respectively, through bracket affixation means in one or more of said bracket means and frame component means;

said front face of said bracket means being operably attachable to said wall through wall attachment means for operably mounting said frame thereon interposed between said wall and said bracket means;

said wall attachment means including position compensation means operably associated therewith to compensate for discrepancies in the heights of one or more of said protruding wall pin members positioned in said wall;

said bracket means, said bracket affixation means, said wall attachment means and said compensation means cooperating with each other and in turn with said protruding wall pin members to provide for affixation and display of said frame apparatus at a desired elevation and orientation upon said wall while allowing for compensation for height discrepancies between said successive protruding pin members; and one or more of said devices being affixable to said frame apparatus at the adjoining position of said rearward attachment surface of said frame component means so as to be capable of joining said frame components, towards mounting said frame apparatus on said wall by engagement and resting of said wall attachment means upon said one or more protruding wall pin members and further cooperating with said compensation means to allow for correction of differences in elevation between said opposite ends so as to permit manual adjustment thereupon.

2. The improved frame hanging and joining device of claim 1 wherein said bracket means further comprises:

a substantially "L"-shaped bracket member having a configuration substantially conforming to the configuration of a portion of said corresponding adjoining frame component means and serving to maintain said frame apparatus in said joined arrangement;

said bracket affixation means comprising a rearwardly facing substantially continuous flanged channel in said frame component means' rearward attachment surface for telescopically accepting remaining ones of said bracket affixation means, said remaining ones of said bracket affixation means including affixation members at said first and second end portions on said bracket member which are capable of being slidingly and telescopically received by and into aligned respective ones of said frame component means' flanged channel;

said wall attachment means being operably affixed to said bracket member at said first and second end portions along said front face of said bracket means so as to integrate said bracket means and said wall attachment means towards positioning said wall attachment means between said wall and said bracket means.

3. The apparatus as described in claim 1 wherein said bracket means comprise:

a bracket member having a configuration substantially conforming to the configuration of a portion of said corresponding adjoining frame components and serving to maintain said frame apparatus in said joined arrangement;

said bracket affixation means including first and second portions of said bracket which fit over portions of said rearward attachment surface in said frame component means so as to be restrainably affixed thereto; and said wall attachment means being operably affixed to said bracket member at ends of said first and second portions along said front face of said bracket means so as to integrate said bracket means and said wall attachment means towards positioning said wall attachment means between said wall and said bracket means.

4. The apparatus as recited in claim 2 wherein said bracket member is comprised of two segments orthogonally joined so as to form said substantially "L" shaped bracket member for cooperation with said respective adjacent frame component means' rearward attachment surfaces for simultaneous formation of a substantially orthogonal corner of said frame apparatus at said joinder of same.

5. The apparatus as recited in claim 1 wherein said affixation means further comprises one or more threaded fastener members passing through said bracket means for fixed receipt by a corresponding orifice in the rearward attachment surface of said frame component means.

6. The apparatus as recited in claim 3 wherein said bracket member is comprised of two segments orthogonally joined so as to form a top bracket portion and depending flanges affixed thereto for cooperation with said respective adjacent rearward attachment surface of said frame component means for simultaneous formation of a substantially orthogonal corner of said frame apparatus at said joinder of same.

7. The apparatus as recited in claim 1 wherein said wall attachment means comprises:

a platform member spanning diagonally from said first end to said second end of said bracket means and which is securely attached thereto at said first and second ends;

said platform member having a plurality of teeth along the periphery of one of its diagonal edges, ranging from a lower most tooth to an upper most tooth, so as to engage and rest upon one or more of said pin members protruding from said wall as desired;

any of said plurality of teeth being capable of engaging and resting upon any of said protruding pin members so as to alter the elevation on said wall of said bracket means upwardly or downwardly by engaging a tooth more proximate said upper most tooth or said lower most tooth;

the vertical distance between said upper most tooth and said lower most tooth of said platform member defining the range of possible alteration of said elevation bracket means on said wall; and said platform member and said protruding pin members on said wall cooperating to in turn position said bracket means and in turn said end of said frame to said wall at any desired elevation within said range of alteration.

8. The apparatus as recited in claim 7 wherein said wall attachment means further comprises:

spacer means are interposed at said first and second ends between said platform member and said bracket so as to provide a clearance space from said frame to in turn permit said platform member to more closely engage one or more of said protruding pin members and mount said frame on said wall, as well as to permit sliding receipt of said bracket means ends within said adjoining ones of said frame components.

9. The apparatus as recited in claim 8 wherein said platform member diagonally spanning between said ends of said bracket means is adjustable along its diagonal position to raise and lower the position of said teeth to accomodate, in a facilitated manner, extreme adjustments in the position of said frame apparatus by varying, to a greater degree, said range of possible alteration.

10. The apparatus as recited in claim 5 wherein said threaded fastener members comprise threaded screw members.

11. The apparatus as recited in claim 1 wherein:

said frame component means comprise a plurality of substantially straight members fitting together in a substantially orthogonal configuration;

said bracket means overlapping and joining together adjacent ones of said straight members at a position proximate to the corners of said frame apparatus so as to maintain said frame apparatus in an assembled rigid fashion while simultaneously providing means for the adjustable positioning and mounting of said apparatus on said wall.

* * * * *